US008610617B1

(12) United States Patent
Avouris et al.

(10) Patent No.: US 8,610,617 B1
(45) Date of Patent: Dec. 17, 2013

(54) GRAPHENE BASED STRUCTURES AND METHODS FOR BROADBAND ELECTROMAGNETIC RADIATION ABSORPTION AT THE MICROWAVE AND TERAHERTZ FREQUENCIES

(75) Inventors: Phaedon Avouris, Yorktown Heights, NY (US); Alberto V. Garcia, Hartsdale, NY (US); Chun-Yung Sung, Poughkeepsie, NY (US); Fengnian Xia, Plainsboro, NJ (US); Hugen Yan, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/530,725

(22) Filed: Jun. 22, 2012

Related U.S. Application Data

(63) Continuation of application No. 13/523,182, filed on Jun. 14, 2012.

(51) Int. Cl.
*H01Q 17/00* (2006.01)

(52) U.S. Cl.
USPC ..... 342/3; 342/13

(58) Field of Classification Search
USPC ..... 342/1–4, 13
See application file for complete search history.

(56) References Cited

U.S. PATENT DOCUMENTS

| | | | | |
|---|---|---|---|---|
| 6,869,581 | B2 | 3/2005 | Kishi et al. | |
| 7,015,142 | B2 | 3/2006 | DeHeer et al. | |
| 7,071,258 | B1 | 7/2006 | Jang et al. | |
| 8,268,180 | B2 * | 9/2012 | Arnold et al. | 216/56 |
| 2009/0135042 | A1 * | 5/2009 | Umishita et al. | 342/1 |
| 2009/0305135 | A1 * | 12/2009 | Shi et al. | 429/217 |
| 2010/0028681 | A1 * | 2/2010 | Dai et al. | 428/408 |
| 2010/0147188 | A1 | 6/2010 | Mamak et al. | |
| 2010/0149018 | A1 * | 6/2010 | Umishita et al. | 342/1 |
| 2011/0089404 | A1 * | 4/2011 | Marcus et al. | 257/29 |
| 2011/0163298 | A1 * | 7/2011 | Sung | 257/29 |
| 2011/0210282 | A1 * | 9/2011 | Foley | 252/62.51 R |

(Continued)

FOREIGN PATENT DOCUMENTS

| | | | |
|---|---|---|---|
| CN | 102502611 | A * | 6/2012 |
| ES | 2369953 | A1 * | 12/2011 |
| WO | WO 2008056123 | A1 * | 5/2008 |
| WO | WO2010022353 | A1 | 2/2010 |

OTHER PUBLICATIONS

De Bellis, G.; De Rosa, I.M.; Dinescu, A.; Sarto, M.S.; Tamburrano, A.; , "Electromagnetic absorbing nanocomposites including carbon fibers, nanotubes and graphene Nanoplatelets," Electromagnetic Compatibility (EMC), 2010 IEEE International Symposium on , vol., no., pp. 202-207, Jul. 25-30, 2010.*

(Continued)

*Primary Examiner* — John B Sotomayor
(74) *Attorney, Agent, or Firm* — Cantor Colburn LLP; Vazken Alexanian

(57) ABSTRACT

Structures and methods for cloaking an object to electromagnetic radiation at the microwave and terahertz frequencies include disposing a plurality of graphene sheets about the object. Intermediate layers of a transparent dielectric material can be disposed between graphene sheets to optimize the performance. In other embodiments, the graphene can be formulated into a paint formulation or a fabric and applied to the object. The structures and methods absorb at least a portion of the electromagnetic radiation at the microwave and terabyte frequencies.

4 Claims, 2 Drawing Sheets

(56) References Cited

U.S. PATENT DOCUMENTS

| | | | | |
|---|---|---|---|---|
| 2011/0250427 | A1* | 10/2011 | Kotov et al. | 428/300.7 |
| 2011/0303121 | A1* | 12/2011 | Geim et al. | 106/287.28 |
| 2011/0303899 | A1* | 12/2011 | Padhi et al. | 257/29 |
| 2012/0039344 | A1* | 2/2012 | Kian et al. | 372/6 |
| 2012/0080086 | A1 | 4/2012 | Yoon et al. | |
| 2012/0213994 | A1* | 8/2012 | Jafry et al. | 428/367 |
| 2012/0265122 | A1* | 10/2012 | El-Shall et al. | 604/20 |
| 2012/0308884 | A1* | 12/2012 | Oguni et al. | 429/209 |
| 2012/0325296 | A1* | 12/2012 | Woo et al. | 136/252 |
| 2013/0001515 | A1* | 1/2013 | Li et al. | 257/24 |
| 2013/0048952 | A1* | 2/2013 | Chen et al. | 257/29 |

OTHER PUBLICATIONS

Sekine, T.; Takahashi, Y.; Nakamura, T.; , "Transparent and double-sided wave absorber with specified reflection and transmission coefficients," Electromagnetic Compatibility—EMC Europe, 2009 International Symposium on , vol., no., pp. 1-3, Jun. 11-12, 2009.*

Tennant, A.; Chambers, B.; , "Phase switched radar absorbers," Antennas and Propagation Society International Symposium, 2001. IEEE , vol. 4, no., pp. 340-343 vol. 4, 2001.*

Yu, H., Wang, T., Xu, Z., Zhu, C., Chen, Y., Wen, B., Sun, C. (2012), Graphene/polyaniline nanorod arrays: Synthesis and excellent electromagnetic absorption properties. Journal of Materials Chemistry, 22(40), 21679-21685.*

Choi, H. et al "Broadband Electromagnetic Response and Ultrafast Dynamics of Few-Layer Epitaxial Graphene", "Applied Physics Letters", vol. 94 (172102); Mar. 1, 2009, pp. 172102-1 through 172102-3.

Fugetsu, Bunshi. et al. "Graphene Oxide as Dyestuffs for the Creation of Electrically Conductive Fabrics", "Carbon", vol. 48 (12); Oct. 2010, pp. 1-27.

Hesjedal, Thorsten. et al. "Continuous Roll-to-Roll Growth of Graphene Films by Chemical Vapor Deposition", "Applied Physics Letters", vol. 98 (133106); Feb. 8, 2011, pp. 133106-1 through 133106-3.

Lee, Chul. et al. "Optical Response of Large Scale Single Layer Graphene", Applied Physics Letters, vol. 98 (071905); Aug. 26, 2011, pp. 071905-1 through 071905-3.

Liu, Jianwei. et al. "Doped Graphene Nanohole Arrays for Flexible Transparent Conductors", "Applied Physics Letters", vol. 99 (023111); Mar. 31, 2011, pp. 023111-1 through 023111-3.

Ludwig, Alon. et al. "ODark Materials Based on Graphene Sheet Stacks", Optics Letters, vol. 36, No. 2; Jan. 15, 2011, pp. 106-107.

LV, Ruitao. et al. "Carbon Nanotubes Filled with Ferromagnetic Alloy Nanowires: Lightwieght and Wide-Band Microwave Absorber", Applied Physics Letters, vol. 93 (223105); Jul. 19, 2008, pp. 223105-1 through 223105-3.

Zhang, X.F.. et al. "Microwave Absorption Properties of the Carbon-Coated Nickel Nanocapsules", Applied Physics Letters, vol. 89 (053115); May 9, 2006, pp. 053115-1 through 053115-2.

Lv et al; Towards new graphene materials: Doped graphene sheets and nanoribbons, Materials Letters, 78 (2012), 209-218.

Yan,e t al; Infrared Spectroscopy of Tunable Dirac Terahertz Magneto-Plasmons in Graphene, Nano Lett. 2012, 12, 3766-3771.

Yan, et al; Tunable infrared plasmononic devices suing graphene/insulator stacks. Nature Nanotechnology. vol. 7, May 2012-330.

* cited by examiner

GRAPHENE BASED STRUCTURES AND METHODS FOR BROADBAND ELECTROMAGNETIC RADIATION ABSORPTION AT THE MICROWAVE AND TERAHERTZ FREQUENCIES

CROSS REFERENCE TO RELATED APPLICATIONS

This application is a continuation application of and claims priority to U.S. application Ser. No. 13/523,182, filed on Jun. 14, 2012, incorporated herein by reference in its entirety.

BACKGROUND

The present disclosure generally relates to structures and methods for absorbing broadband electromagnetic waves using graphene, and more particularly, to methods and structures of graphene sheets configured to absorb the broadband electromagnetic waves at the microwave and terahertz frequencies being emitted from a electromagnetic wave generating source.

The development of broadband absorption materials at the microwave and terahertz spectrum range is currently being investigated for numerous commercial and military applications. For example, terahertz radar systems are capable of probing the detailed structure of targets on a sub-millimeter scale while being able to distinguish between materials in terms of the spectral dependence of absorption. For military applications, weapons or personnel could be detected through catalogue or thin foliage and targets discriminated from background on the basis of spectral response. The use of broadband absorption materials that completely absorb the incident electromagnetic waves of interest, e.g., the terahertz frequencies, such that no transmission and reflection occurs can be used to effectively hide the target. However, most known material systems for such purposes rely on resonance peaks in the absorption spectrum and as such, a broadband solution is still lacking.

SUMMARY

According to an embodiment, a method for cloaking an object by absorbing electromagnetic radiation at microwave and terahertz frequencies comprises providing a plurality of graphene sheets on or about the object to be cloaked from the electromagnetic radiation.

In another embodiment, a method for cloaking an object by absorbing electromagnetic radiation at microwave and terahertz frequencies comprises disposing alternating layers of a graphene sheet and a transparent dielectric layer on or about the object to be cloaked from the electromagnetic radiation at least a portion of the microwave and terahertz frequencies.

In another embodiment, a method for cloaking an object by absorbing electromagnetic radiation at microwave and terahertz frequencies comprises applying a graphene flake containing paint formulation to the object to be cloaked from the electromagnetic radiation; drying the graphene flake containing paint formulation; and reapplying the graphene flake containing paint formulation until a desired thickness and a desired minimal reflection are obtained.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
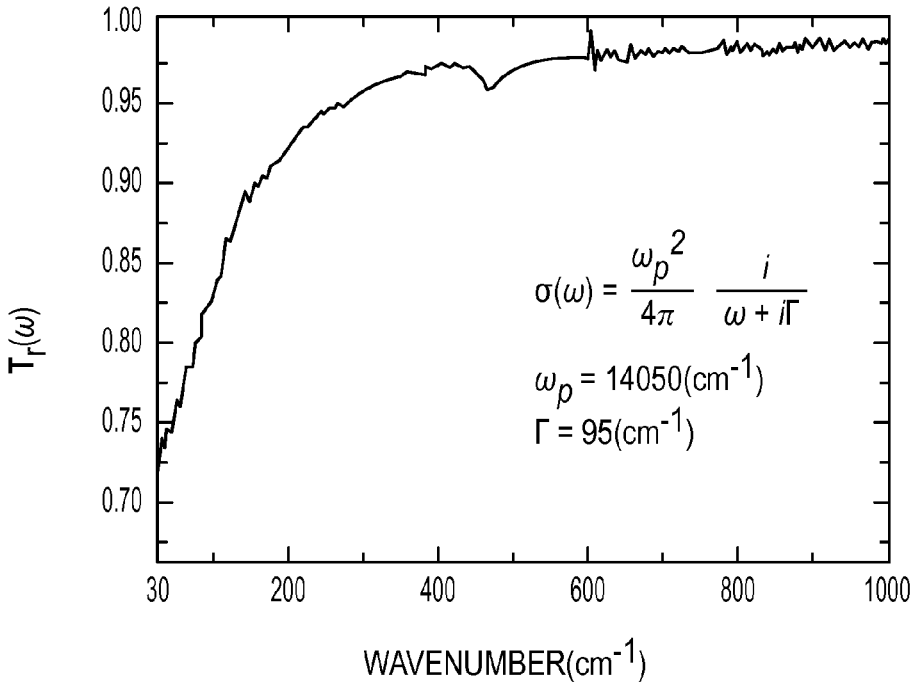
FIG. 1 illustrates transmission spectrum of a single layer of graphene in the far infrared and terahertz regions.

Disclosed herein are electromagnetic broadband absorption structures and methods for absorbing at least a portion of the electromagnetic radiation emitted from an electromagnetic radiation source at the microwave and terahertz frequencies. By providing broadband absorption of electromagnetic waves at the microwave and terahertz frequencies, an object can effectively be hidden at these frequencies since the broadband electromagnetic waves are absorbed and no transmission or reflection occurs. As used herein, the term "microwave" generally refers to the wavelength range of 1 millimeter to 1 meter (i.e., 300 MHz to 300 GHz) whereas the term "terahertz" generally refers sub-millimeter wave energy that fills the wavelength range between 1000 to 100 microns (i.e., 300 GHz to 3 THz)

The electromagnetic broadband absorption structures are generally formed from a plurality of graphene sheets, wherein the electromagnetic broadband absorption structure is effective to absorb at least a portion of the electromagnetic radiation at the microwave and terahertz frequencies. The number of graphene sheets will generally depend on the intended application and the desired minimal reflection for the particular application. A typical graphene "layer" may comprise a single sheet or multiple sheets of graphene, for example, between 1 sheet and 1000 sheets in some embodiments, and between about 10 sheets and 100 sheets in other embodiments. In most embodiments, the resulting graphene layer comprised of the graphene sheets can have a thickness of about 1 nanometer to about 100 nanometers, and a thickness of about 10 nm to about 80 nm in other embodiments.

Graphene is a two dimensional allotrope of carbon atoms arranged in a planar, hexagonal structure. It features useful electronic properties including bipolarity, high purity, high mobility, and high critical current density. Electron mobility values as high as 200,000 $cm^2/Vs$ at room temperature have been reported.

Structurally, graphene has hybrid orbitals formed by sp2 hybridization. In the sp2 hybridization, the 2s orbital and two of the three 2p orbitals mix to form three sp2 orbitals. The one remaining p-orbital forms a pi-bond between the carbon atoms. Similar to the structure of benzene, the structure of graphene has a conjugated ring of the p-orbitals which exhibits a stabilization that is stronger than would be expected by the stabilization of conjugation alone, i.e., the graphene structure is aromatic. Unlike other allotropes of carbon such as diamond, amorphous carbon, carbon nanofoam, or fullerenes, graphene is not an allotrope of carbon since the thickness of graphene is one atomic carbon layer i.e., a sheet of graphene does not form a three dimensional crystal.

Graphene has an unusual band structure in which conical electron and hole pockets meet only at the K-points of the Brillouin zone in momentum space. The energy of the charge carriers, i.e., electrons or holes, has a linear dependence on the momentum of the carriers. As a consequence, the carriers behave as relativistic Dirac-Fermions having an effective mass of zero and moving at the effective speed of light of ceJf£106 msec. Their relativistic quantum mechanical behavior is governed by Dirac's equation. As a consequence, graphene sheets have a large carrier mobility of up to 60,000 cm2/V-sec at 4K at 300K, the carrier mobility is about 15,000 cm2/V-sec. Also, quantum Hall effect has been observed in graphene sheets.

The linear dispersion of graphene around the K (K') point leads to constant interband absorption (from valence to conduction bands, about 2.3%) of vertical incidence light in a very broadband wavelength range. More interestingly, at the microwave and terahertz frequency ranges, intraband absorption dominates and a single layer can absorb as much as 30% at a light wavelength of 300 microns depending on the carrier concentration in the graphene as evidenced by the transmission spectrum provided in FIG. 1. As a result, utilization of graphene for microwave and terahertz frequency absorption has numerous advantages such as being an ultra-thin and efficient absorption layer relative to other materials. Moreover, because graphene is a one atom thick monolayer sheet formed of carbon atoms packed in a honeycomb crystalline lattice, wherein each carbon atom is bonded to three adjacent carbon atoms via $sp^2$ bonding, the overall thickness required to provide effective absorption is minimal is on the order of a few nanometers. As such, the use of graphene sheets provides minimal added weight to the object to be shielded, has broadband absorption capabilities, and provides greater versatility than prior art structures. Moreover, graphene is generally recognized for its high mechanical strength and high stability which are desirable properties for most applications.

The graphene sheets can be made by any suitable process known in the art including mechanical exfoliation of bulk graphite, for example, chemical deposition, growth, or the like. Currently, among the conventional methods of forming a graphene layer, the method of forming the graphene layer by chemical vapor deposition is being frequently used because a large area graphene layer can be produced at a relatively low cost.

By way of example only, chemical vapor deposition (CVD) onto a metal (i.e., foil) substrate can be used to form the graphene sheets. To form the graphene layer by chemical vapor deposition, a precursor is selected so that the catalytic decomposition of the precursor forms the graphene layer. The precursor may be a gas, liquid, or solid hydrocarbon such as methane, ethylene, benzene, toluene, and the like. The precursor may also include and be mixed with other materials such as hydrogen gas, for example.

The CVD process may be implemented at atmospheric pressure or the vacuum chamber of the CVD apparatus may be evacuated below atmospheric pressure. In one embodiment, the vacuum chamber is pressurized between 100 mTorr and 500 m Torr. The CVD apparatus may also be configured to heat the substrate to be coated with the graphene. For example, the substrate can be heated up to about 1200° C. or higher as may be desired with some precursors and applications.

Chemical exfoliation may also be used to form the graphene sheets. These techniques are known to those of skill in the art and thus are not described further herein.

The graphene can be formed on a substrate as may be desired in some applications. The particular substrate is not intended to be limited and may even include the electromagnetic radiation source itself. For example, the structural material may include foams, honeycombs, glass fiber laminates, Kevlar fiber composites, polymeric materials, or combinations thereof. Non-limiting examples of suitable structural materials include polyurethanes, silicones, fluorosilicones, polycarbonates, ethylene vinyl acetates, acrylonitrile-butadiene-styrenes, polysulfones, acrylics, polyvinyl chlorides, polyphenylene ethers, polystyrenes, polyamides, nylons, polyolefins, poly(ether ether ketones), polyimides, polyetherimides, polybutylene terephthalates, polyethylene terephthalates, fluoropolymers, polyesters, acetals, liquid crystal polymers, polymethylacrylates, polyphenylene oxides, polystyrenes, epoxies, phenolics, chlorosulfonates, polybutadienes, neoprenes, nitriles, polyisoprenes, natural rubbers, and copolymer rubbers such as styrene-isoprene-styrenes, styrene-butadiene-styrenes, ethylene-propylenes, ethylene-propylene-diene monomers (EPDM), nitrile-butadienes, and styrene-butadienes (SBR), and copolymers and blends thereof. Any of the forgoing materials may be used unfoarned or, if required by the application, blown or otherwise chemically or physically processed into open or closed cell foam.

The shape of the substrate is not intended to be limited. For example, the substrate may have planar and/or curvilinear surfaces such as may be found in foils, plates, tubes, and the like.

Once the graphene sheets are formed, the sheets can be deposited onto a desired object using conventional lift-off techniques or may be deposited directly onto the substrate of interest. In general, the sheets are deposited one on top of another to form the film. Thus, by way of example only, the graphene film can comprise a stack of multiple graphene sheets (also called layers). The term "substrate" is used to generally refer to any suitable substrate on which one would want to deposit a graphene film and have that particular substrate effectively hidden from electromagnetic radiation at the microwave and terahertz frequencies.

Figure 2:
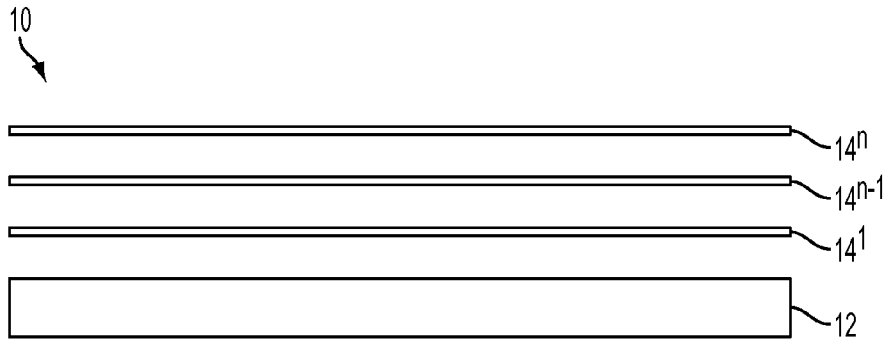
FIG. 2 illustrates an electromagnetic broadband absorption structure for absorbing electromagnetic radiation at the microwave and terahertz spectrums, the structure including a plurality of graphene sheets according to an embodiment.

In one embodiment shown in FIG. 2, the electromagnetic broadband absorption structure 10 for absorbing electromagnetic radiation at the microwave and terahertz frequencies includes a plurality of graphene sheets 14', $\mathbf{14}^2$, . . . $\mathbf{14}^n$ directly transferred to the substrate of interest 12. The number of graphene sheets utilized will generally vary depending on the intended application and the desired level of minimal reflection for the particular application.

Figure 3:
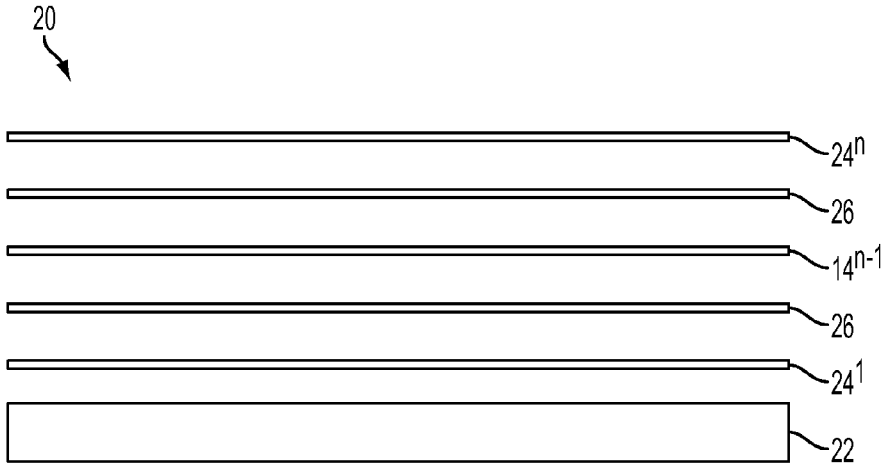
FIG. 3 illustrates an electromagnetic broadband absorption structure for absorbing electromagnetic radiation at the microwave and terahertz spectrums, the structure including a plurality of graphene sheets separated by transparent intermediate layers according to an embodiment.

In another embodiment shown in FIG. 3, the electromagnetic broadband absorption structure 20 disposed on or about an object 22 for absorbing electromagnetic radiation at the microwave and terahertz frequencies includes one or more graphene sheets $\mathbf{24}^1$, $\mathbf{24}^2$, . . . $\mathbf{24}^n$, wherein intermediate the graphene sheets are transparent intermediate dielectric layer 26.

In one embodiment, suitable dielectric materials include, without limitation, silicon dioxide, silicon nitride, porous silicon dioxide, polyimide, polynorbornenes, benzocyclobutene, methylsilsequioxanes, a doped glass layer, such as phosphorus silicate glass, boron silicate glass, and the like. In other embodiments, the dielectric layer can be a low k dielectric layer, wherein low k generally refers to materials having a dielectric constant less than silicon dioxide. Exemplary low k dielectric materials include, without limitation, SiLK® from Dow Chemical, Coral® from Novellus, Black Diamond® from Applied Materials, and spin on dielectrics can be used. Coral® can be described generically as a SiCOH dielectric. Depending upon the particular dielectric material, dielectric layer can be formed by chemical vapor deposition deposited (CVD), plasma enhanced chemical vapor deposition (PECVD), atmospheric deposition as well as spin on techniques. In one embodiment, the dielectric layer is a chemical vapor deposited material, such as silicon dioxide or silicon nitride, deposited between adjacent graphene layers. By adjusting the refractive index and thickness of the intermediate dielectric layers, the performance of the structure can be optimized for a particular application.

Figure 4:
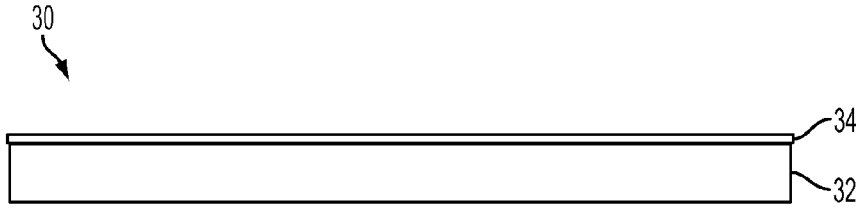
FIG. 4 illustrates an electromagnetic broadband absorption structure for absorbing electromagnetic radiation at the microwave and terahertz spectrums, the structure including a coating containing graphene flakes according to an embodiment.

In another embodiment shown in FIG. 4, the electromagnetic broadband absorption structure 30 for absorbing electromagnetic radiation at the microwave and terahertz frequencies includes one or more coatings 34 of a paint formulation including graphene flakes as a pigment applied to a surface of an object 32 for cloaking. The amount of graphene flakes can generally be varied within the paint formulation. However, a high concentration is generally preferred so as to minimize coating thickness. The other components of the paint formulation including a binder, e.g., latex, can be those conventionally employed in paint formulations so long as the other components do not interfere with the absorption properties provided by the graphene flakes. For example, the binder may include synthetic or natural resins such as alkyds, acrylics, vinyl-acrylics, vinyl acetate/ethylene (VAE), polyurethanes, polyesters, melamine resins, epoxy, or oils. Binders may be categorized according to the mechanisms for drying or curing. Although drying may refer to evaporation of the solvent or thinner, it usually refers to oxidative cross-linking of the binders and is indistinguishable from curing. Some paints form by solvent evaporation only, but most rely on cross-linking processes. The paint formulation can also include a wide variety of miscellaneous additives, which are usually added in small amounts. By way of example, typical additives may be included to modify surface tension, improve flow properties, improve the finished appearance, increase wet edge, improve pigment stability, impart antifreeze properties, control foaming, control skinning, etc. Other types of additives include catalysts, thickeners, stabilizers, emulsifiers, texturizers, adhesion promoters, UV stabilizers, flatteners (de-glossing agents), biocides to fight bacterial growth, and the like Once applied to the substrate of interest, the painted coating can provide high absorption at the microwave and terahertz frequencies once applied to the substrate of interest.

Optionally, a fabric or cloth including the graphene flakes can be provided to provide an object to be cloaked with uncloaking capabilities, when desired. Moreover, the fabric or cloth can be shared with multiple objects. The terms fabric or cloth generally refers to a flexible artificial material that is made by a network of natural or artificial fibers. The fabric can be impregnated and/or woven with the graphene flakes, which may include a binder to facilitate adhesion of the graphene flakes to the fabric. The fabric itself is not intended to be limited to any particular type. The graphene flakes may be prepared by mechanical exfoliation as graphite bulk to yield micron sized graphene flakes such as is generally described in US Patent Publication No. 2010/0147188, incorporated herein by reference in its entirety. It may also be commercially obtained from GrafTech INternaional Ltd, Parma Ohio as GRAFGUARD®.

Substrates that include graphene layers and/or graphene flakes as discussed above provide reduced terahertz microwave and infrared crossections. As a result, the substrate itself will be effectively hidden since the graphene layers and/or graphene flakes are low transmitting and low reflectively materials, the degree of which will generally depend on the thickness and density of the graphene. Such optimization is well within the skill of those of ordinary skill in the art.

It will be understood that when an element or layer is referred to as being "on," "interposed," "disposed," or "between" another element or layer, it can be directly on, interposed, disposed, or between the other element or layer or intervening elements or layers may be present.

It will be understood that, although the terms first, second, third, and the like may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, first element, component, region, layer or section discussed below could be termed second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for cloaking an object by absorbing electromagnetic radiation at microwave and terahertz frequencies, comprising:

disposing alternating layers of a graphene sheet and a transparent dielectric layer on or about the object to be cloaked from the electromagnetic radiation, wherein the transparent dielectric layer is intermediate two graphene sheets; and absorbing at least a portion of the microwave and terahertz frequencies.

2. The method of claim 1, further comprising adjusting a selected one of a refractive index, a thickness or the refractive index and the thickness of the dielectric layer.

3. The method of claim 1, wherein the object comprises curvilinear surfaces.

4. The method of claim 1, wherein the graphene sheets are formed by chemical vapor deposition.

* * * * *